US006393717B1

(12) United States Patent
Santos et al.

(10) Patent No.: US 6,393,717 B1
(45) Date of Patent: May 28, 2002

(54) FOOT DRYER DEVICE WITH DIFFUSED HEATED AIR FLOW SYSTEM

(76) Inventors: Victor M. Santos, P.O. Box 7302, Metairie, LA (US) 70010; Maria C. Zapata, 532 Sabal Lake Dr. #100, Longwood, FL (US) 32779

( * ) Notice: Subject to any disclaimer, the term of this patent is extended or adjusted under 35 U.S.C. 154(b) by 0 days.

(21) Appl. No.: 09/768,738

(22) Filed: Jan. 24, 2001

(51) Int. Cl.[7] ..... F26B 19/00

(52) U.S. Cl. ..... 34/90; 34/231; 34/232; 392/380; 392/383

(58) Field of Search ..... 34/90, 91, 218, 34/231, 232, 233; 392/279, 380, 382, 383

(56) References Cited

U.S. PATENT DOCUMENTS 1,658,489 A * 2/1928 Lindstrom ..... 34/239
2,779,856 A * 1/1957 Fahner ..... 392/382
4,782,601 A * 11/1988 Gonzalez ..... 34/233
5,438,764 A 8/1995 Reppas et al. ..... 34/343
5,454,060 A * 9/1995 McDermott ..... 392/383
5,491,908 A 2/1996 Ruiz et al. ..... 34/202
5,613,304 A 3/1997 Lin ..... 34/90
5,617,646 A 4/1997 Viscuso ..... 34/60
5,819,431 A 10/1998 Lancer ..... 34/90

* cited by examiner

*Primary Examiner*—Ira S. Lazarus
*Assistant Examiner*—Kathryn S. O'Malley
(74) *Attorney, Agent, or Firm*—Joseph N. Breaux

(57) ABSTRACT

A foot dryer device for completely drying the feet of the user that utilizes a heat/blower mechanism in connection with an air diffusion assembly that diffuses a heated air stream so as to prevent uncomfortable hot spots from occurring on the feet of the user. The heater/blower mechanism is activated by the user when he/she steps onto a user support grate positioned above the air diffuser.

1 Claim, 4 Drawing Sheets

FOOT DRYER DEVICE WITH DIFFUSED HEATED AIR FLOW SYSTEM

TECHNICAL FIELD

The present invention relates to health care products and more particularly to a foot dryer device with diffused heated air flow system for thoroughly drying the feet of a user to help prevent athletes foot and other foot conditions, the foot dryer device including a molded bottom housing, a heater assembly, and a user support grate; the user support grate being constructed from rigid, non-heat conductive plastic having an outer support frame supporting a planar grating structure forming a number of diffused, heated air flow passageways and providing a user support surface of sufficient size and strength to support a user standing thereon; the molded bottom housing having a dome-shaped diffuser structure completely covering the top area of the molded bottom housing and having a number of air diffusion passageways formed entirely therethrough between the top surface of diffuser structure top and the bottom surface of diffuser structure top each having a diffuser passageway diameter less than the thickness between the top surface of diffuser structure top and the bottom surface of diffuser structure top, a bottom housing top opening sized to receive therein the outer support frame of the user support grate and defined by a top interior housing edge, a circumferential foot grate frame support ledge extending into an air space cavity, defined above the top surface of diffuser structure top and below the top interior housing edge, from an interior sidewall surface of the molded bottom housing, a user support grate retainer in mechanical relation with the outer support frame of the user support grate to maintain the outer support frame slidably positioned above the circumferential foot grate frame support ledge, a number of drain holes provided through the sidewall of the base housing .at a level even with the top surface of diffuser structure top such that water dripping from a user supported on the user support grate onto the dome-shaped diffuser structure is channeled by the top surface of diffuser structure top toward one of the number of drain holes whereupon it flows out of the molded bottom housing, and an air intake opening provided through the molded bottom housing into connection with the dome-shaped diffuser structure; the heater assembly including a variable speed fan having a fan blade for generating a fan air flow along an air flow path connected to the dome-shaped diffuser structure beginning with air flowing in through the air intake opening of the molded bottom housing and ending with diffused air currents exiting from the number of air diffusion passageways of the dome-shaped diffuser structure, a variable speed fan controller in controlling electrical connection with the variable speed fan in a manner to control the intensity of the fan air flow, an electric heater element positioned in the airflow path in a manner to add heat to the air of the fan air flow, a temperature controller in controlling connection with the electric heater element, a normally open, watertight momentary contact switch in power source controlling electrical connection with the variable speed fan and the electric heater element having an actuator positioned in connection between the molded bottom housing and the user support grate such that the weight of a user supported on the user support grate generates and maintains an actuating force sufficient to actuate and maintain the normally open, watertight momentary contact switch in the closed state supplying electrical power to the variable speed fan and the electric heater element, a detachable air filter positioned in the air intake opening of the molded bottom housing, and a two-position power switch wired in parallel electrical relation to the normally open, watertight, momentary contact switch to allow a user to manually activate the foot dryer device without the need for pressing down on the user support grate to actuate the normally open, watertight, momentary contact switch.

BACKGROUND ART

It is often difficult for an individual to properly dry his/her feet prior to putting on shoes. Because a damp foot placed within a shoe can provide favorable conditions for fungal infections, such as athlete's foot and the like, to occur and to spread, it would be a benefit to have a foot dryer device which provided a hot air stream which could be blown onto the feet to completely dry the feet before placing them into shoes. Because most air blowing dryers, such as hair dryers, can generate hot spots if directed at the same location for too long, it would be a further benefit to have a foot dryer device for completely drying the feet of the user that utilized a blower mechanism in connection with an air diffusion assembly that diffused a heated air stream so as to prevent uncomfortable hot spots from occurring on the feet of the user as well as to ensure that the entire foot of the user was covered with an even flow of heated air in order to ensure rapid complete drying.

GENERAL SUMMARY DISCUSSION OF INVENTION

It is thus an object of the invention to provide a foot dryer device with diffused heated air flow system that includes a molded bottom housing, a heater assembly, and a user support grate; the user support grate being constructed from rigid, non-heat conductive plastic having an outer support frame supporting a planar grating structure forming a number of diffused, heated air flow passageways and providing a user support surface of sufficient size and strength to support a user standing thereon; the molded bottom housing having a dome-shaped diffuser structure completely covering the top area of the molded bottom housing and having a number of air diffusion passageways formed entirely therethrough between the top surface of diffuser structure top and the bottom surface of diffuser structure top each having a diffuser passageway diameter less than the thickness between the top surface of diffuser structure top and the bottom surface of diffuser structure top, a bottom housing top opening sized to receive therein the outer support frame of the user support grate and defined by a top interior housing edge, a circumferential foot grate frame support ledge extending into an air space cavity, defined above the top surface of diffuser structure top and below the top interior housing edge, from an interior sidewall surface of the molded bottom housing, a user support grate retainer in mechanical relation with the outer support frame of the user support grate to maintain the outer support frame slidably positioned above the circumferential foot grate frame support ledge, a number of drain holes provided through the sidewall of the base housing at a level even with the top surface of diffuser structure top such that water dripping from a user supported on the user support grate onto the dome-shaped diffuser structure is channeled by the top surface of diffuser structure top toward one of the number of drain holes whereupon it flows out of the molded bottom housing, and an air intake opening provided through the molded bottom housing into connection with the dome-shaped diffuser structure; the heater assembly including a variable speed fan having a fan blade for generating a fan air flow along an air flow path connected to the dome-shaped diffuser structure beginning with air flowing in through the air intake opening of the molded bottom housing and ending with diffused air currents exiting from the number of air diffusion passageways of the dome-shaped diffuser structure, a variable speed fan controller in controlling electrical connection with the variable speed fan in a manner to control the intensity of the fan air flow, an electric heater element positioned in the airflow path in a manner to add heat to the air of the fan air flow, a temperature controller in controlling connection with the electric heater element, a normally open, watertight momentary contact switch in power source controlling electrical connection with the variable speed fan and the electric heater element having an actuator positioned in connection between the molded bottom housing and the user support grate such that the weight of a user supported on the user support grate generates and maintains an actuating force sufficient to actuate and maintain the normally open, watertight momentary contact switch in the closed state supplying electrical power to the variable speed fan and the electric heater element, a detachable air filter positioned in the air intake opening of the molded bottom housing, and a two-position power switch wired in parallel electrical relation to the normally open, watertight, momentary contact switch to allow a user to manually activate the foot dryer device without the need for pressing down on the user support grate to actuate the normally open, watertight, momentary contact switch.

Accordingly, a foot dryer device with diffused heated air flow system is provided. The foot dryer device with diffused heated air flow system includes a molded bottom housing, a heater assembly, and a user support grate; the user support grate being constructed from rigid, non-heat conductive plastic having an outer support frame supporting a planar grating structure forming a number of diffused, heated air flow passageways and providing a user support surface of sufficient size and strength to support a user standing thereon; the molded bottom housing having a dome-shaped diffuser structure completely covering the top area of the molded bottom housing and having a number of air diffusion passageways formed entirely therethrough between the top surface of diffuser structure top and the bottom surface of diffuser structure top each having a diffuser passageway diameter less than the thickness between the top surface of diffuser structure top and the bottom surface of diffuser structure top, a bottom housing top opening sized to receive therein the outer support frame of the user support grate and defined by a top interior housing edge, a circumferential foot grate frame support ledge extending into an air space cavity, defined above the top surface of diffuser structure top and below the top interior housing edge, from an interior sidewall surface of the molded bottom housing, a user support grate retainer in mechanical relation with the outer support frame of the user support grate to maintain the outer support frame slidably positioned above the circumferential foot grate frame support ledge, a number of drain holes provided through the sidewall of the base housing at a level even with the top surface of diffuser structure top such that water dripping from a user supported on the user support grate onto the dome-shaped diffuser structure is channeled by the top surface of diffuser structure top toward one of the number of drain holes whereupon it flows out of the molded bottom housing, and an air intake opening provided through the molded bottom housing into connection with the dome-shaped diffuser structure; the heater assembly including a variable speed fan having a fan blade for generating a fan air flow along an air flow path connected to the dome-shaped diffuser structure beginning with air flowing in through the air intake opening of the molded bottom housing and ending with diffused air currents exiting from the number of air diffusion passageways of the dome-shaped diffuser structure, a variable speed fan controller in controlling electrical connection with the variable speed fan in a manner to control the intensity of the fan air flow, an electric heater element positioned in the airflow path in a manner to add heat to the air of the fan air flow, a temperature controller in controlling connection with the electric heater element, a normally open, watertight momentary contact switch in power source controlling electrical connection with the variable speed fan and the electric heater element having an actuator positioned in connection between the molded bottom housing and the user support grate such that the weight of a user supported on the user support grate generates and maintains an actuating force sufficient to actuate and maintain the normally open, watertight momentary contact switch in the closed state supplying electrical power to the variable speed fan and the electric heater element, a detachable air filter positioned in the air intake opening of the molded bottom housing, and a two-position power switch wired in parallel electrical relation to the normally open, watertight, momentary contact switch to allow a user to manually activate the foot dryer device without the need for pressing down on the user support grate to actuate the normally open, watertight, momentary contact switch.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
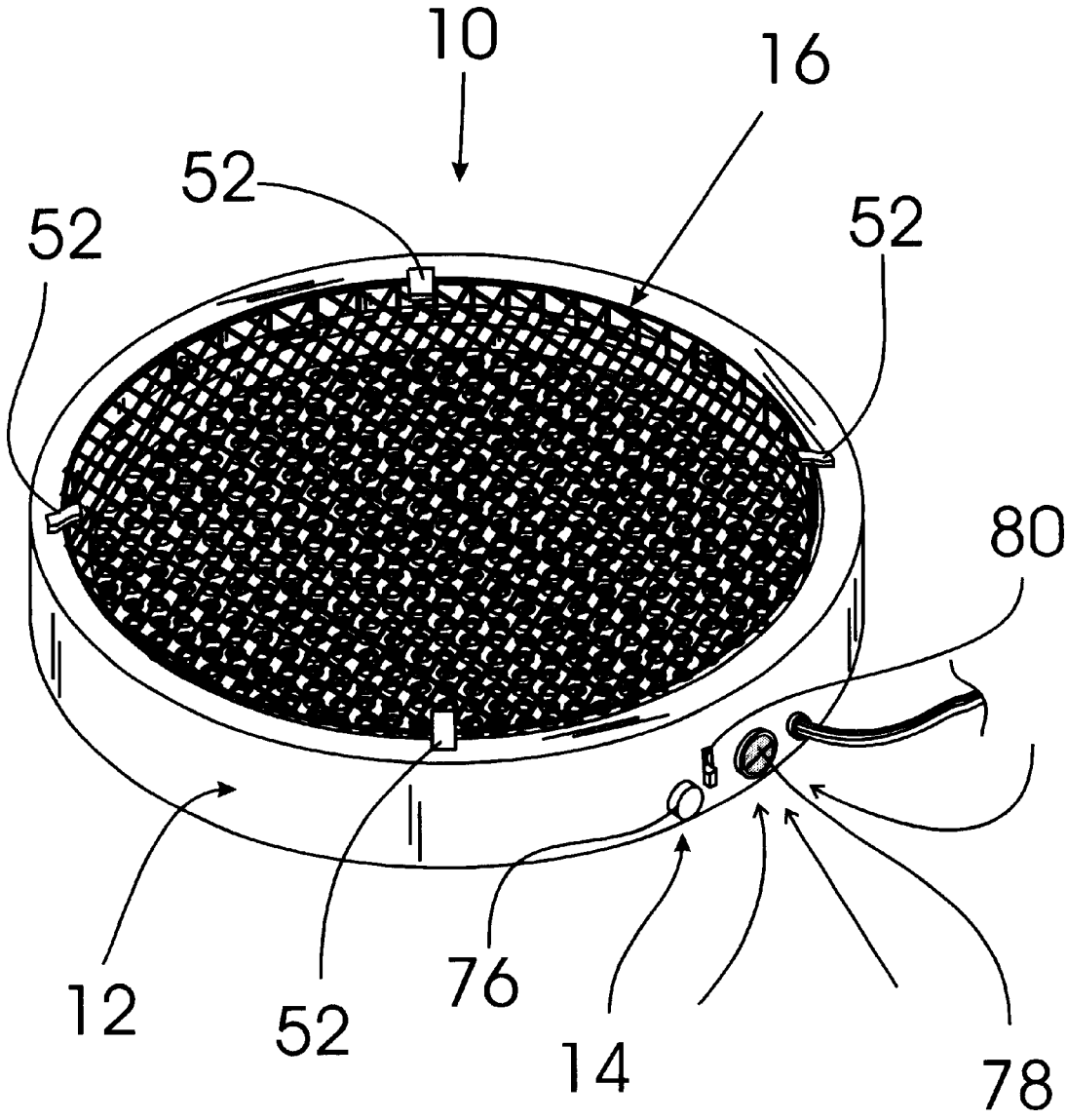
FIG. 1 is a perspective view of an exemplary embodiment of the foot dryer device with diffused heated air flow system of the present invention.
Figure 2:
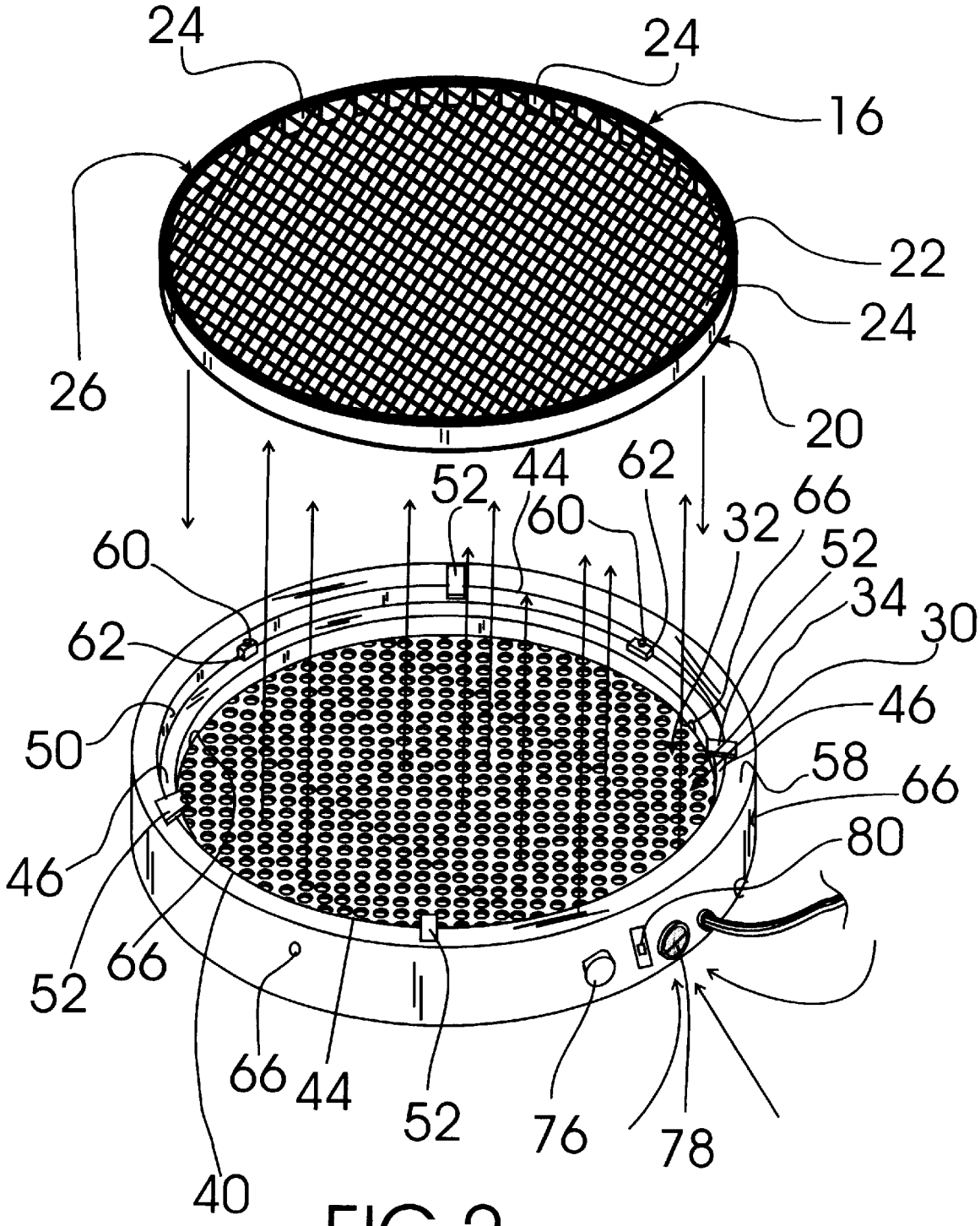
FIG. 2 is a partially exploded perspective view of the foot dryer device with diffused heated air flow system of FIG. 1 with the user support grate exploded away from the molded bottom housing.
Figure 3:
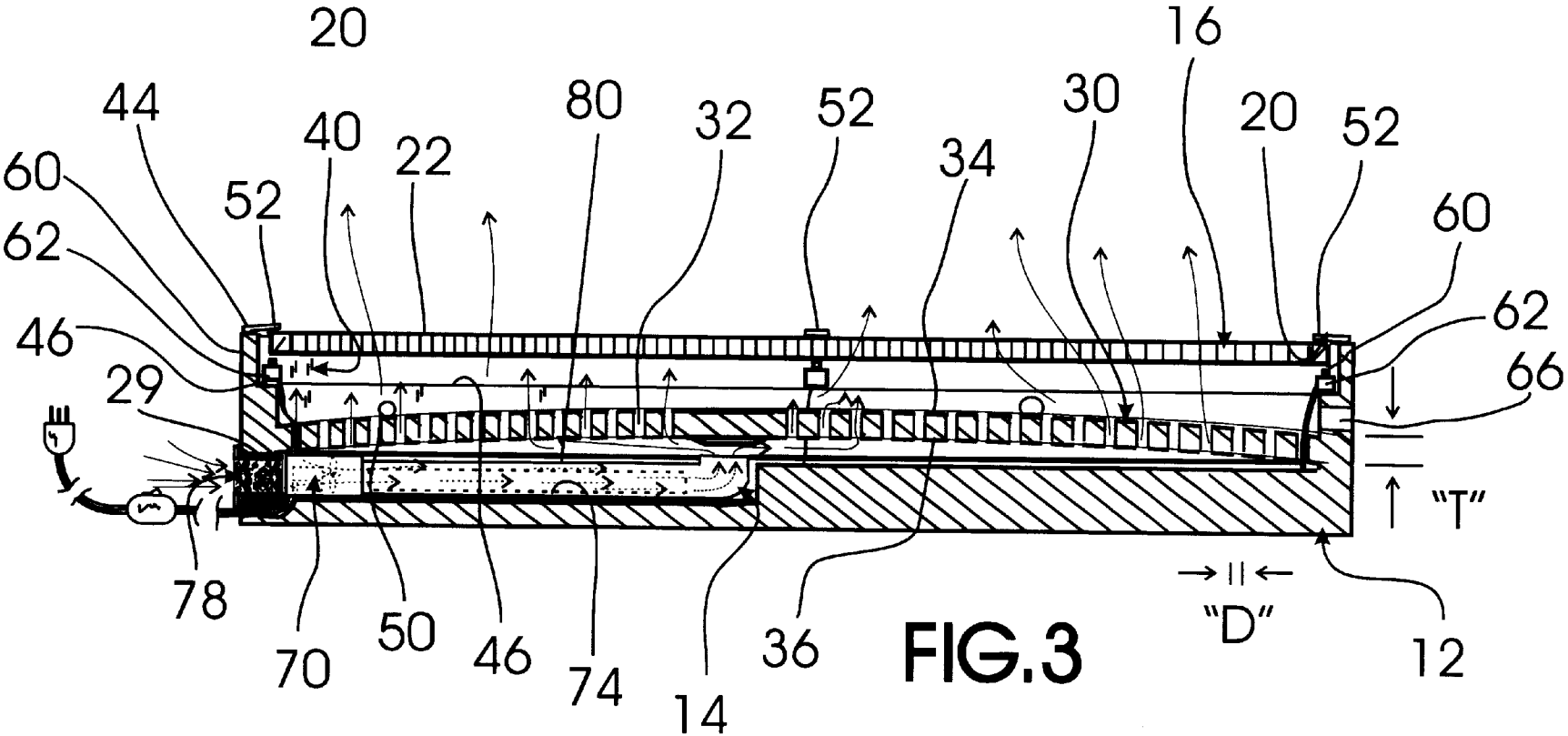
FIG. 3 is a cross section view of an exemplary embodiment of the foot dryer device with diffused heated air flow system of the present invention showing the molded bottom housing, a heater assembly, and a user support grate.
Figure 4:
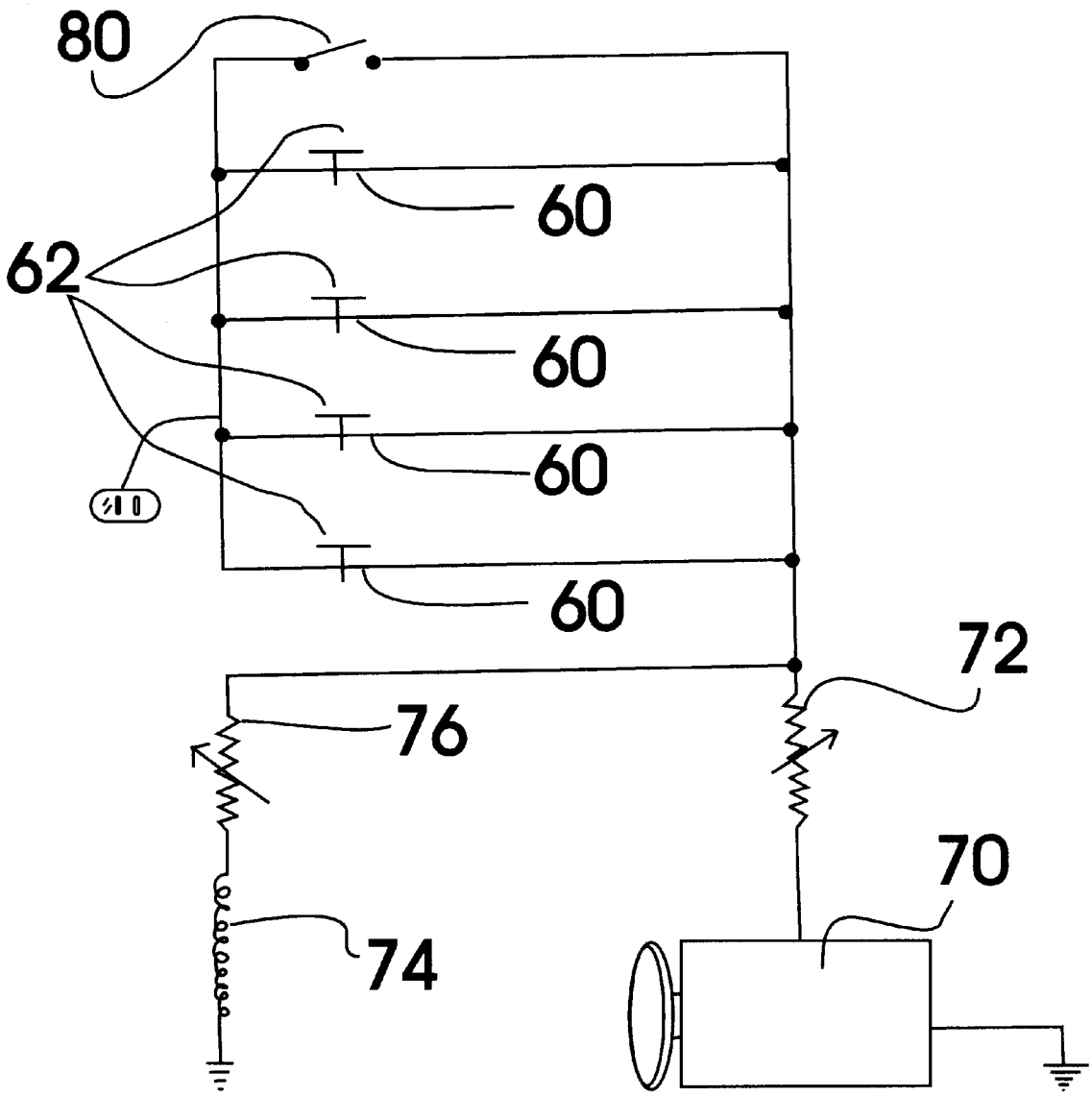
FIG. 4 is a schematic diagram of an exemplary embodiment of the heater assembly of the foot dryer device with diffused heated air flow system of the present invention.

FIGS. 1–4 illustrate various aspects of exemplary embodiments of the foot dryer device with diffused heated air flow system of the present invention generally designated 10. Foot dryer device with diffused heated air flow system 10 includes a molded bottom housing, generally designated 12; a heater assembly, generally designated 14; and a user support grate, generally designated 16.

User support grate 16 is constructed from rigid, non-heat conductive plastic and has circular, outer support frame 20 supporting a planar grating structure 22 that forms a large number of diffused, heated air flow passageways 24 and a disk-shaped user support surface, generally designated 26, of sufficient size and strength to support a user standing thereon.

Molded bottom housing 12 is molded from rigid, heat resistant, non-heat conducting plastic and has an air intake opening 29 provided through molded bottom housing 12 and connected to a dome-shaped diffuser structure, generally designated 30, completely covering the top area of molded bottom housing 12 and having a number of air diffusion passageways 32 formed entirely therethrough between the top surface of diffuser structure top 34 and the bottom surface of diffuser structure top 36. Each air diffusion passageway 32 has a diffuser passageway diameter "D" equal to one-sixteenth of an inch which is less than the thickness "T" between the top surface of diffuser structure top 34 and the bottom surface of diffuser structure top 36. Diffuser passageway diameter "D" and the length "T" of air diffusion passageways 32 are selected such that water droplets are unable to flow down through air diffusion passageways 32 when air is blowing out of the top opening of the air diffusion passageways 32 because the surface tension of the water results in water droplets that are too large to enter and flow through when air is flowing in the opposite direction. This prevents water from entering the dome-shaped diffuse structure 30 and the electric heater assembly 14. Molded bottom hosing 12 also includes a disk-shaped bottom housing top opening, generally designated 40, that is sized to receive therein outer support frame 20 of user support grate 16 and defined by a top interior housing edge 44. A circumferential foot grate frame support ledge 46 extends into an air space cavity 48, defined above the top surface of diffuser structure top 34 and below the top interior housing edge 44, from an interior sidewall surface 50 of molded bottom housing 12. In this embodiment, molded bottom housing 12 includes four flexible plastic user support grate retainers 52 that extend away from a top housing surface 58 to maintain user support grate 16 slidably positioned up and down above the circumferential foot grate frame support ledge 46 and supported by the actuators 60 of the four parallel wired normally open, watertight momentary contact switches 62 of the heater assembly 14. In this embodiment, four drain holes 66 provided through the sidewall of molded base housing 12 at a level even with top surface of diffuser structure top 34 such that water dripping from a user supported on user support grate 16 onto dome-shaped diffuser structure 30 is channeled by top surface of diffuser structure top 34 toward one of the four drain holes 66 whereupon the water flows out of molded bottom housing 12.

In this embodiment, heater assembly 14 includes a variable speed fan, generally designated 70, a variable speed fan controller 72, an electric heater element 74, a temperature controller 76, four normally open, watertight momentary contact switches 62, a detachable air filter 78, and a two-position manual override power switch 80. Variable speed fan 70 has a rotating fan blade for generating a fan air flow along an air flow path connected to dome-shaped diffuser structure 30 beginning with air flowing in through air intake opening 29 of molded bottom housing 12 through filter 78 and ending with diffused air currents exiting from the number of air diffusion passageways of dome-shaped diffuser structure 30. Variable speed fan controller 72 is wired in controlling electrical connection with variable speed fan 70 in a manner to allow the user to control the intensity of the fan air flow. Electric heater element 74 is positioned within a heat-proof cover tube 88 to maintain the airflow path across electric heater element 74 so that electric heater element 74 adds heat to the air of the fan air flow. Temperature controller 76 is electrically wired in controlling connection with electric heater element 74 to allow the user to adjust the heat added from between zero and a maximum temperature selected to prevent injuries to the user and safe operation of dryer device 10. In this embodiment, the maximum temperature of the air exiting heat-proof cover tube 88 is one-hundred-twenty degrees Fahrenheit. It is of course within the spirit and the scope of the invention taught herein to select maximum temperatures that are less than or greater than the exemplary maximum temperature. The four normally open, watertight momentary contact switches 62 are wired in parallel with each other and in series with variable speed fan 70 and electric heater element 74. Each of the four normally open, watertight momentary contact switches 62 is installed on circumferential foot grate frame support ledge 46 at ninety degree intervals each with its watertight actuator 60 positioned upward in supporting contact with circular, outer support frame 20 of user support grate 16. The weight of user support grate 16 alone is insufficient to actuate any of the four normally open, watertight momentary contact switches 62. In use, the weight of a user supported on user support grate 16 generates and maintains an actuating force sufficient to actuate and maintain the four normally open, watertight momentary contact switches 62 in the closed state supplying electrical power to variable speed fan 70 and electric heater element 74. If a user desires to use foot dryer device 10 in a continuous mode, he/she can bypass the normal activation switches 62 by positioning a two-position manual override power switch 80 that is wired in parallel electrical relation to the four normally open, watertight, momentary contact switches 62 into the on position.

It can be seen from the preceding description that a foot dryer device with diffused heated air flow system has been provided.

It is noted that the embodiment of the foot dryer device with diffused heated air flow system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A foot dryer device with diffused heated air flow system comprising:

a molded bottom housing;

a heater assembly; and a user support grate;

said user support grate being constructed from rigid, non-heat conductive plastic having an outer support frame supporting a grating structure forming a number of diffused, heated air flow passageways and providing a user support surface of sufficient size and strength to support a user standing thereon;

said molded bottom housing having a dome-shaped diffuser structure completely covering the top area of said molded bottom housing and having a number of air diffusion passageways formed entirely therethrough between the top surface of diffuser structure top and the bottom surface of diffuser structure top each having a diffuser passageway diameter less than said thickness between said top surface of diffuser structure top and said bottom surface of diffuser structure top, a bottom housing top opening sized to receive therein said outer support frame of said user support grate and defined by a top interior housing edge, a circumferential foot grate frame support ledge extending into an air space cavity, defined above said top surface of diffuser structure top and below said top interior housing edge, from an interior sidewall surface of said molded bottom housing, a user support grate retainer in mechanical relation with said outer support frame of said user support grate to maintain said outer support frame slidably positioned above said circumferential foot grate frame support ledge, and an air intake opening provided through said molded bottom housing into connection with said dome-shaped diffuser structure;

said heater assembly including a fan having a fan blade for generating a fan air flow along an air flow path connected to said dome-shaped diffuser structure beginning with air flowing in through said air intake opening of said molded bottom housing and ending with diffused air currents exiting from said number of air diffusion passageways of said dome-shaped diffuser structure, an electric heater element positioned in said airflow path in a manner to add heat to said air of said fan air flow, a normally open, watertight momentary contact switch in power source controlling electrical connection with said fan and said electric heater element having an actuator positioned in connection between said molded bottom housing and said user support grate such that said weight of a user supported on said user support grate generates and maintains an actuating force sufficient to actuate and maintain said normally open, watertight momentary contact switch in said closed state supplying electrical power to said fan and said electric heater element causing them to operate.

* * * * *